US007210489B2

(12) United States Patent
Eiermann

(10) Patent No.: US 7,210,489 B2
(45) Date of Patent: May 1, 2007

(54) DISHWASHER

(75) Inventor: Rüdiger Eiermann, Sygenstein (DE)

(73) Assignee: BSH Bosch und Simens Hausgeraete GmbH, Munich (DE)

( * ) Notice: Subject to any disclaimer, the term of this patent is extended or adjusted under 35 U.S.C. 154(b) by 318 days.

(21) Appl. No.: 10/872,662

(22) Filed: Jun. 21, 2004

(65) Prior Publication Data

US 2004/0255992 A1 Dec. 23, 2004

Related U.S. Application Data

(63) Continuation of application No. PCT/EP02/12779, filed on Nov. 14, 2002.

(30) Foreign Application Priority Data

Dec. 19, 2001 (DE) ..... 101 62 506

(51) Int. Cl.
*B08B 3/02* (2006.01)

(52) U.S. Cl. ..... 134/135; 134/182; 134/198

(58) Field of Classification Search ..... 134/176, 134/179, 199, 198, 182, 170, 135
See application file for complete search history.

(56) References Cited

U.S. PATENT DOCUMENTS

| | | | | | |
|---|---|---|---|---|---|
| 1,202,147 | A | * | 10/1916 | Barnstead | 422/303 |
| 1,596,854 | A | * | 8/1926 | Okrainetz | 134/199 |
| 2,239,110 | A | * | 4/1941 | Mahoney | 134/199 |
| 2,407,533 | A | * | 9/1946 | Brock | 134/199 |
| 2,619,977 | A | * | 12/1952 | Hagen | 134/177 |
| 3,319,640 | A | * | 5/1967 | La Flame | 134/139 |
| 3,463,173 | A | | 8/1969 | Goldman | |
| 3,595,253 | A | * | 7/1971 | Yanez-Pastor et al. | 134/105 |
| 3,620,050 | A | * | 11/1971 | Glasgow | 68/3 SS |
| 3,854,998 | A | * | 12/1974 | Jacobs | 134/191 |
| 3,978,875 | A | * | 9/1976 | Slany | 134/112 |
| 4,708,153 | A | * | 11/1987 | Hambleton et al. | 134/170 |
| 5,937,875 | A | * | 8/1999 | Nygren | 134/22.11 |

FOREIGN PATENT DOCUMENTS

| | | |
|---|---|---|
| FR | 1 233 812 A | 10/1960 |
| FR | 2 075 488 A7 | 10/1971 |
| FR | 2 544 606 A1 | 10/1984 |
| GB | 1 138 291 | 12/1968 |

* cited by examiner

*Primary Examiner*—Frankie L. Stinson
(74) *Attorney, Agent, or Firm*—Russell W. Warnock; Craig J. Loest

(57) ABSTRACT

A dishwashing machine containing spraying devices and at least one dish rack. The dishwashing machine has at least one dish rack having stationary spraying devices to optimally clean material stacked in the at least one rack and increase and optimize storage room in the dishwashing machine.

8 Claims, 3 Drawing Sheets

DISHWASHER

Figure 1:
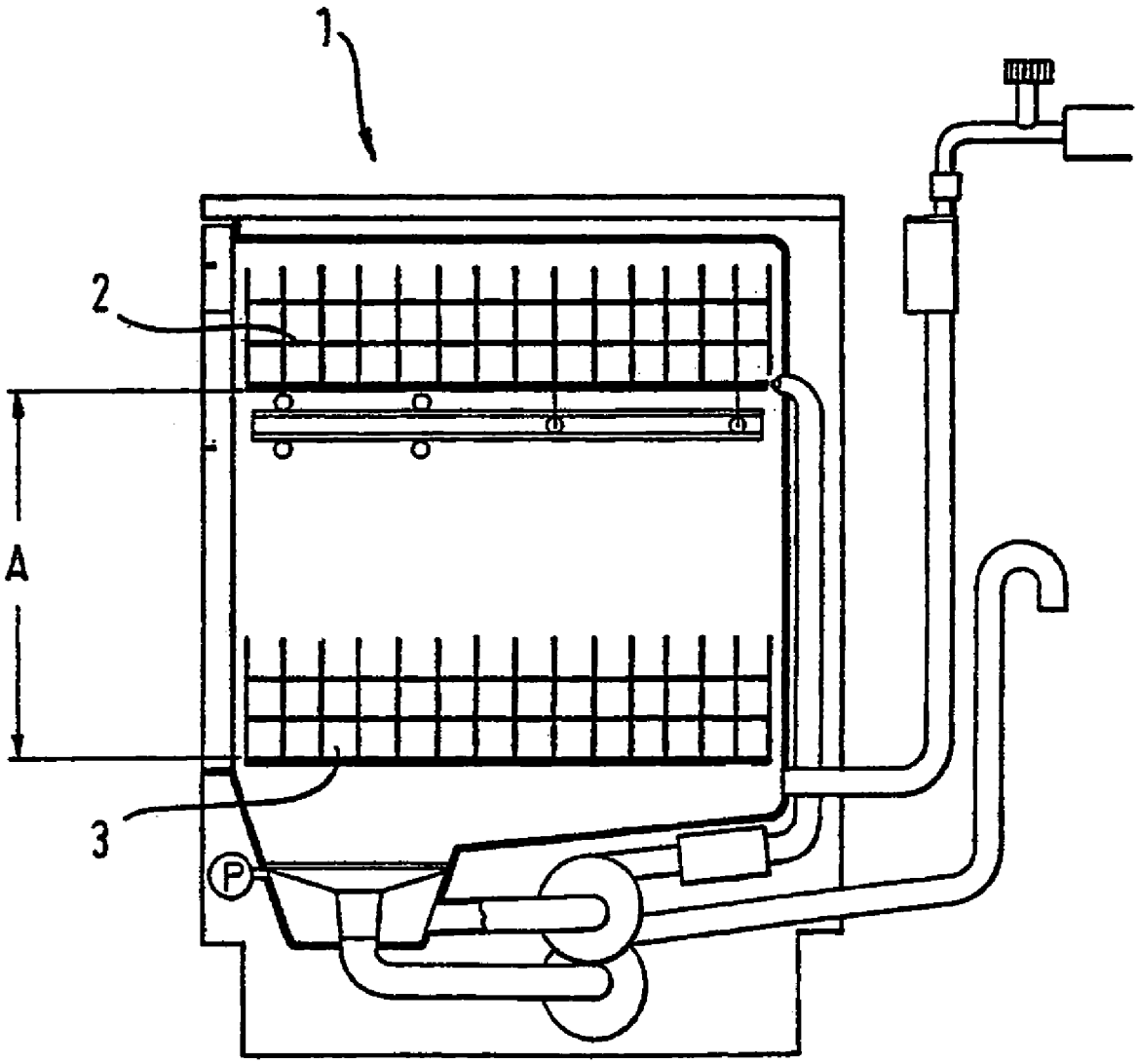

The object of the present invention is a dishwasher with at least one dish rack and a dish rack comprising a rack unit for stacking items to be washed.

In conventional dishwashers racks are used, to which so-called spray arms are assigned arranged on their underside, which are connected to a circulation pump via coupling devices. During the wash cycle water or a so-called rinsing water is pumped through supply tubes, which flows through the hollow spray arms and leaves the spray arms through nozzle-like openings, in order to supply the items to be washed stacked above and possibly also below the spray arms in dish racks with the rinsing water to thus clean these items to be washed.

To set the spray arms in rotation the nozzle-like openings of the spray arms are designed and arranged such that a corresponding rotation speed is reached, while adequate vertical spraying force for cleaning the items to be washed is guaranteed at the same time. The arrangement of the spray arms under the dish rack ensures that the rotation of the spray arm can run unhindered, since the items to be washed do not protrude into the area of action of the subjacent spray arms. Similarly it must be ensured that the items to be washed located under the spray arm of the upper rack are inserted into the lower rack such that the rotation of the spray arm of the upper rack is likewise not hindered.

On account of the spatial dimensions of the dish racks and the subjacent spray arms the spray arms arranged under the dish racks substantially reduce the space available in the rinse container, limited as it is.

The object of the present invention is therefore to optimise the limited storage room for items to be washed in the rinse container, while maintaining the cleaning capacity of the dishwasher.

This task is solved by the inventive dishwasher or by the inventive dish rack as claimed. Advantageous further developments of the present invention are characterised in the independent claims.

The inventive dishwasher has at least one dish rack, whereby the at least one dish rack is configured free of mobile spraying devices and the items to be washed are sprayed via stationary spraying devices.

The inventive dish rack comprises a rack unit for holding items to be washed, whereby the dish rack is free of mobile spraying devices and the items to be washed are sprayed by stationary spraying devices.

According to a preferred characteristic of the invention the stationary spraying devices are configured as spraying tubes.

According to another characteristic of the invention the spraying tubes are fitted with nozzle-like openings, through which the rinsing water exits.

According to a preferred embodiment of the invention the spraying tubes are in each case arranged under a dish rack.

In a particularly advantageous manner the spraying tubes are configured as rack components of the dish rack, such that the rack units made for example of unsheathed metallic wire have a greater mesh width, which are covered by the spraying tubes to form a holder for the items to be washed.

By way of advantage the spraying tubes are arranged meandering under the dish rack to ensure even rinsing.

Due to the inventive arrangement the available space of the rinse container is utilised to the maximum, since no inner clearance must be left free under the upper rack for e.g. the rotational motion of the spray arms.

According to an advantageous embodiment of the invention the spraying tubes are supplied via a central region, which is configured and arranged such that during a wash cycle the rinsing water flows via a fitting into the central region and thus into the spraying tubes.

By way of advantage the central region comprises a plurality of tube sections, which terminate in a tube section or alternatively have separate terminals.

According to yet another advantageous embodiment of the invention the central region is configured as a jet dispenser.

Figure 2:
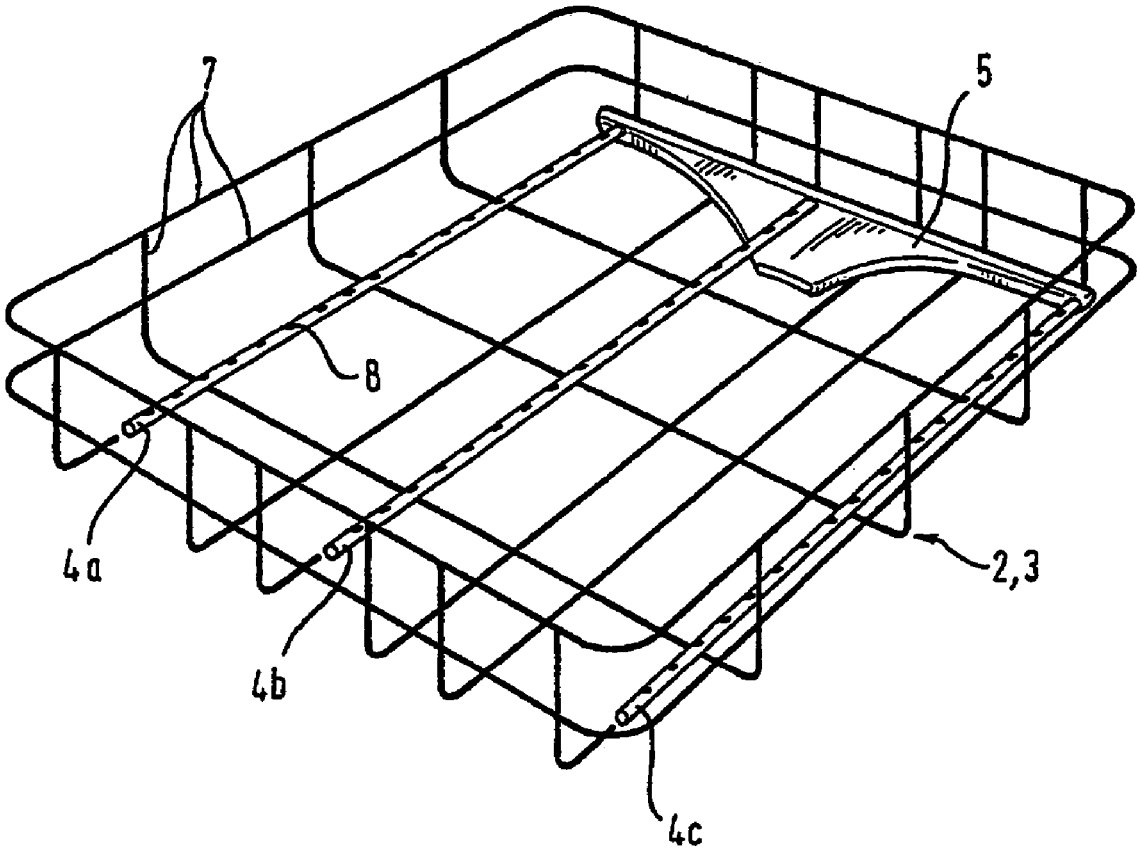
Figure 3:
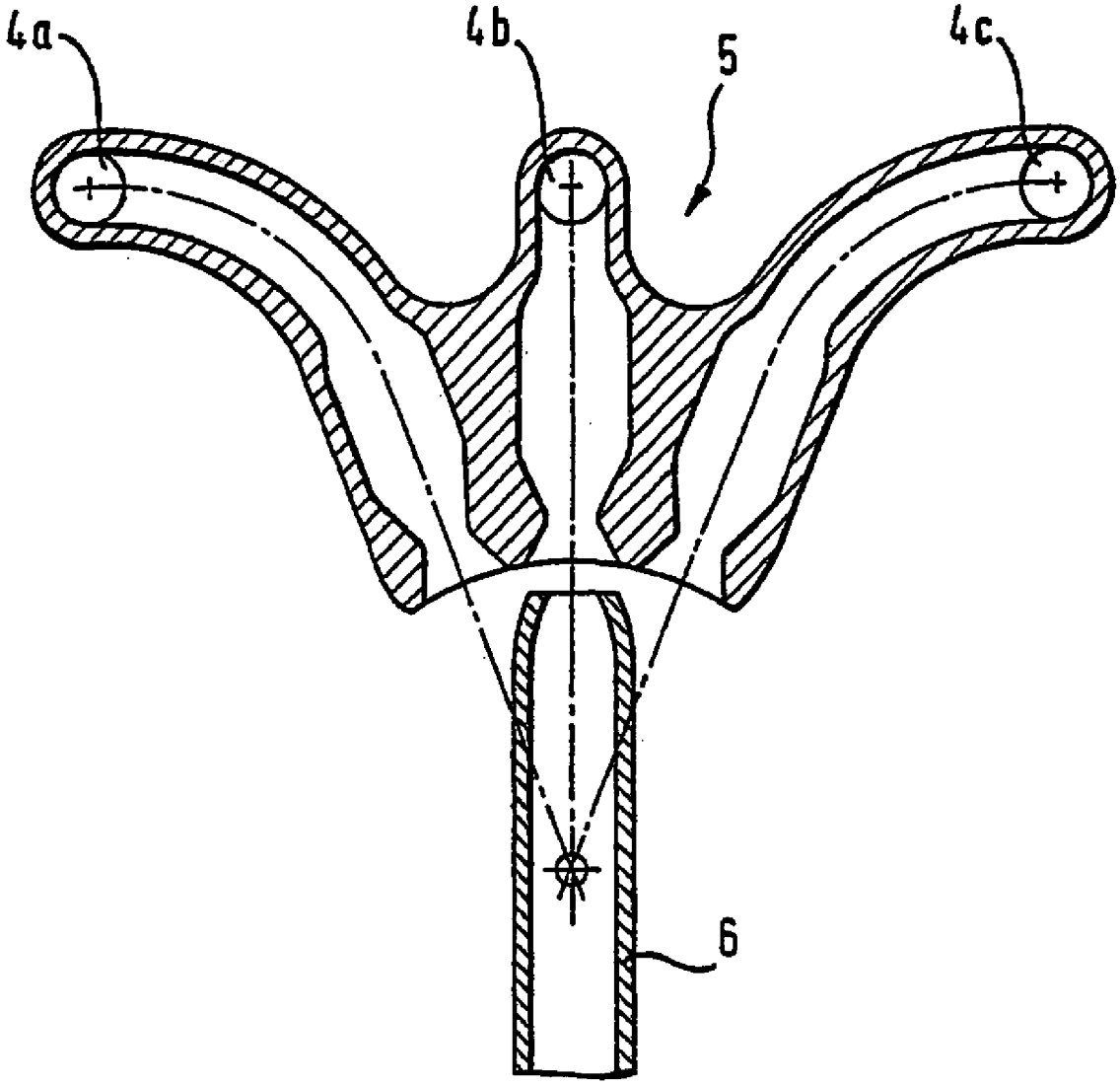

A preferred embodiment of the present invention will now be explained in greater detail hereinbelow by means of figures, in which:

FIG. 1 is a schematic sectional illustration of an inventive dishwasher with two inventive dish racks, FIG. 2 is a perspective illustration of an inventive dish rack, and FIG. 3 is a sectional illustration through a central region attached to an inventive dish rack, as well as a fitting arranged adjacent thereto.

In the arrangement according to FIG. 1 an inventive dishwasher 1 is shown in a schematic sectional illustration, whereby both the upper rack and the lower rack are configured free of mobile spraying devices, e.g. rotating spray arms. Due to the inventive arrangement the available space A of the rinse container is utilised to the maximum, since no inner clearance must be left free under the upper rack for the rotational movement of the spray arms. With conventional dishwasher dimensions the thus obtained spatial height is ca. 3 to 7 cm, and from time to time even up to 8 cm and more space gained. Apart from the spatial height obtained under the upper rack the lower rack can be arranged deeper down in the rinse container, so that considerable space gain is made by the inventive measure.

In FIG. 2 an inventive dish rack 2, 3 is illustrated, which can be used both as upper rack and as lower rack. The inventive dish rack 2, 3 comprises a rack unit, which conventionally comprises unsheathed wire sections 7. On account of their wide mesh spacing these wire sections 7 form a net for the rinsing water to flow through, while at the same time the items to be washed stacked in the dish rack cannot fall through the mesh net of the rack.

To achieve the optimal space utilisation of the rack unit 2, 3, single wire sections are replaced or formed by straight spraying tubes 4. Alternatively, the spraying tubes can also be arranged meandering under the dish rack, thus ensuring uniform spraying. In addition to a straight or meandering arrangement of the spraying tubes it can possibly also be effective to arrange the spraying tubes in a star or spiral pattern under the dish rack. As shown in FIG. 2, the spraying tubes 4 terminate in a central region 5, which is configured and arranged such that the rinsing water flows into the central area 5 and thus into the spraying tubes 4 via a fitting, not shown here.

To ensure even flow of the rinsing water into the spraying tubes 4 (4*a*, 4*b*, 4*c*) according to a preferred embodiment as in FIG. 3, the fitting 6 is pivoted by a mechanism, not described in greater detail here, and thus the rinsing water flowing in through the fitting 6 is deflected to the central region 5, which divides the rinsing water off to the respective spraying tubes in the manner of a flow divider.

The invention claimed is:

1. A dishwasher for washing items placed therein, comprising:

at least one dish rack, said dish rack being configured without a mobile spraying device; and the items placed in said dish rack are sprayed and washed with liquid supplied by at least one stationary spraying device, said stationary spraying device being configured as at least one spraying tube attached to the rack and each said spraying tube being supplied with liquid from a central region which is configured and arranged such that during a wash cycle fluid flows through a fitting into said central region and from said central region in turn into each said spraying tube.

2. The dishwasher according to claim 1, including said central region includes a plurality of separate tube sections, each of which terminate and communicate with one of said spraying tubes.

3. The dishwasher according to claim 1, including said central region includes a plurality of separate tube sections, each of which has a separate terminal.

4. The dishwasher according to claim 3, including said central region is configured as a jet divider.

5. A dish rack, comprising:

at least one rack unit for stacking items to be washed therein; said rack unit is configured without a mobile spraying device; and said items stacked in said dish rack are sprayed and washed with liquid supplied by at least one stationary spraying device said stationary spraying device being configured as at least one spraying tube attached to the rack and each said spraying tube being supplied with liquid from a central region which is configured and arranged such that during a wash cycle fluid flows through a fitting into said central region and from said central region in turn into each said spraying tube.

6. The dish rack according to claim 5, including said central region includes a plurality of separate tube sections, each of which terminate and communicate with one of said spraying tubes.

7. The dish rack according to claim 5, including said central region includes a plurality of separate tube sections, each of which has a separate terminal.

8. The dish rack according to claim 7, including said central region is configured as a jet divider.

* * * * *